United States Patent [19]

Niems

[11] 4,123,850

[45] Nov. 7, 1978

[54] APPARATUS FOR PYROPROCESSING AND COOLING PARTICLES

[76] Inventor: Lee H. Niems, 2702 Brassie, Flossmoor, Ill. 60422

[21] Appl. No.: 799,221

[22] Filed: May 23, 1977

[51] Int. Cl.[2] ..... F26B 7/00; F27D 15/00

[52] U.S. Cl. ..... 34/20; 432/78; 432/106

[58] Field of Search ..... 34/20; 432/77, 78, 79, 432/106

[56] References Cited

U.S. PATENT DOCUMENTS

| | | | |
|---|---|---|---|
| 2,275,116 | 3/1942 | Vogel-Jorgensen | 34/20 |
| 2,859,955 | 11/1958 | Petersen | 432/78 |
| 2,994,521 | 8/1961 | Azbe | 432/79 |

FOREIGN PATENT DOCUMENTS

| | | | |
|---|---|---|---|
| 1,135,816 | 8/1962 | Fed. Rep. of Germany | 432/79 |
| 43-16,540 | 12/1968 | Japan | 432/77 |

*Primary Examiner*—John J. Camby
*Attorney, Agent, or Firm*—Charles F. Schroeder

[57] ABSTRACT

A rotary kiln and cooling apparatus for pyroprocessing and cooling of pieces of matter and particularly calcined lime pebbles, the kiln being provided with sized discharge openings near its end for discharge of the product into a cooling unit. The discharge openings are sized to discharge particles in an acceptable range while oversized pieces are passed on and discharged out the end of the kiln into a disposal region, thus segregating the particles without the usually required grates and manual labor and permitting handling of hotter materials.

13 Claims, 8 Drawing Figures

APPARATUS FOR PYROPROCESSING AND COOLING PARTICLES

BACKGROUND OF THE INVENTION

This invention is directed to apparatus for pyroprocessing of particulate materials here exemplified by calcined lime pebbles such as are produced from limestone heat-processed in a kiln. The invention is not limited to processing of lime pebbles alone, however, since it may be applied to other heat processed particles of matter such as deadburned dolomite, cement, expanded clay or shale, and the like. The term particles as used herein refers to the many forms of such material including large and small pieces, pebbles, granules, broken solids, fragments, clinkers, etc. In this regard, lime particles processed in the apparatus herein described may, for example, range in their size from dust less than 60 mesh to 2 inches in size to much large particles or agglomerates of lime and kiln coating.

Calcining of lime is typically accomplished in a kiln such as a generally horizontal but inclined rotary kiln heated by one or more burners. In rotary and other types of kilns, it is customary to subject the material being processed to flame temperatures in the order of 2800° F. to calcine the limestone charge. The hot lime exiting from the calcining zone is then deposited on top of a generally vertical cooling bed through which cooling air is passed in counterflow relation to the particle flow in the bed to reduce the temperature of the line to a level that permits subsequent conveying, storage and shipment within a reasonable space and a reasonably short time period. Contemporaneously therewith the sensible heat of the hot lime is picked up by the cooling air which is thereafter directed to the kiln as preheated air for combustion.

FIELD OF THE INVENTION

Cooling of heated pieces of lime and other materials have been accomplished quite successfully in shaft type coolers exemplified by the coolers disclosed in my U.S. Pat. Nos. 3,578,297, 3,721,017 and 3,731,398 as well as my earlier U.S. Pat. Nos. 2,858,123, 2,901,837 and 2,970,828. These coolers fall within the classification of shaft type coolers wherein material is received continuously directly from the kiln and then is moved gradually downward within the cooler bed where it resides for a period typically in the order ¾ to 1½ hours to provide the necessary time for heat transfer from the particulate matter to air passing up therethrough. The cooling air is introduced into the downwardly moving mass of particles from a lower region to effect counterflow cooling without unbalanced flow of air or material. To promote maximum efficiency in the overall system in which the kiln and the cooling unit are incorporated, the heat extracted from the particulate matter by the cooling air is returned to the combustion process as preheated air for combustion and, in some instances, is also used for drying the coal used as a fuel.

PRIOR ART

Upon passage of the particles from the kiln to the bed of the cooling unit it is usually passed through grates mounted horizontally or sometimes on a slope and with openings sized to pass the normal size range of product and to reject oversized pieces of coating from the kiln or random pieces of refractory that might have spalled off or dropped out of the kiln lining. The grates are made of heat resistant material such as chrome nickel alloy to withstand the high temperature of the preheated air and the particulate matter flowing from the kiln. Without such grates, the oversized pieces would pass into the bed of the cooling unit and act to block the lower regions rendering it, in many instances, inoperable. In addition, the grates assure a quality product by segregating out the oversized coating or refractory matter which would otherwise render the product poor in quality.

THE PROBLEM

Such grates, however, are objectionable and even impractical for large size kilns. By way of explanation, in the case of small rotary kilns, horizontal grates have been acceptable from the standpoint of keeping them free of debris, since the amount of debris involved and required to be removed is not more than can be routinely raked off the grates by a kiln fireman or his helper. However, with large kilns or coal fired kilns wherein substantial quantities of coating are handled, or deadburned dolomite kilns, or lightweight aggregate kilns, or cement kilns which more or less continuously form balls and coatings which are oversized, the amount of coating to be removed from the grates would demand anywhere from one to several men on a full time basis just to keep the grates clean. If not kept free of such coating, a buildup of material would occur on the grates which would require that the kiln be shut down.

Thus in the case of large kilns it is highly impractical to utilize a shaft type cooler requiring manual cleaning of grates. Attempts have been made to provide mechanically cleaned grates, or traveling grates, but because of the high temperatures of operation of such equipment, other mechanical difficulties and maintenance problems arise to cause them to be less practical than desired.

Beside the difficulties presented in operation, the capital investment in grates and their required support beams are a considerable portion of the total cooler cost, and their maintenance is a high percentage of the total maintenance costs.

In view of the foregoing it is an object of the present invention to provide a kiln arrangement whereby particles can be segregated without grates and manual labor and can be fed continuously to the cooler at less cost in operation, maintenance and capital investment while at the same time permitting handling of hotter materials than usual such as deadburned dolomite or the extremely large agglomerations found in lightweight aggregate kilns.

Another object of this invention is to provide means which will effect an even distribution of the hot matter flowing from the kiln over the bed of a cooler unit. In this regard, previous cooler units have been offset from the centerline of the kiln to more or less compensate for the fact that the material tends to discharge on the side of the kiln in the direction of rotation where the load is carried. Deflector plates of various configurations have been used in the prior art both above and below horizontal grates to improve distribution of the matter over the surface of a cooler bed. When used above the grates, however, they have the disadvantage of interferring with the removal of coating. When used below the grates they cannot be readily repositioned to optimize distribution, and in addition are not readily accessible for maintenance. Such deflectors also eventually deteriorate and may drop into the cooler, causing blockage and shutdown.

Another problem confronted in operation of shaft type coolers is flowback of finer material into the kiln as air from the cooler passes up through the material falling from the kiln. This pickup of finer material is particularly noticeable as the material falling from the kiln impinges on the bars of the grate and it falls into the cooler. A feature of the present invention, however, is that a grate is not needed to effect segregation of particles. At the same time, my arrangement lends itself to flow of air from the cooler through a path which minimizes or eliminates the possibility of flowback of particles into the kiln.

By elimination of the particle segregating grate, and reducing or eliminating the possibility of flowback of fine material into the kiln, another feature of the present invention is that it may in some instances reduce the height requirements of the cooler.

BRIEF DESCRIPTION OF THE INVENTION

The above objectives and features of my invention are attained by constructing the kiln with a series of material discharge ports distributed about the circumference of the kiln wall near the end of the kiln. The discharge openings are made of size and shape such that output portions of less than a predetermined size can pass through the ports and be deposited in the bed of an underlying cooler. The ports may also be equipped with grids to limit the size of material passed. Oversized kiln coating material, balls, and debris that would otherwise block the cooler unit if permitted to be deposited in the cooler bed will pass over these openings and roll out the end of the kiln into a suitable coating chute for disposal rather than into the cooler. Thus the ports effect a selective separation and passage of acceptable output product to the cooler but cause oversized material or debris to be channelled out the end of the kiln for disposal or further processing all without attention or effort on the part of the personnel operating the kiln.

A feature of the invention is that the amount of chrome nickel or other high temperature alloys required is only a fraction of the amount required in previous coolers such as for grates and supports.

Another feature of the invention is that the output of the kiln can be more ideally deposited from the ports directly into a shaft type cooler with a better pattern of distribution in the bed than was heretofore achievable with intermediate grates. Since the output of the kiln passes through a series of ports, a broader distribution of material can be effected over a greater arc of travel on the kiln interior than if all the matter were to exit directly from the end of the kiln. In addition, the exit distribution can be further improved by provision of adjustable deflectors immediately under the outlet regions from the kiln ports. Beside deflectors, my invention also contemplates the use of downpipes which can be arranged to direct the material to desired locations such as to the exact center of the cooler bed, or to the center of each of a number of sections of the bed.

Other objects and features which are believed to be characteristic of my invention are set forth with particularity in the appended claims. My invention, however, both in organization and manner of construction, together with further objects and features thereof may be best understood with reference to the following description taken in connection with the accompanying drawings in which:

DESCRIPTION OF THE INVENTION

Figure 1:
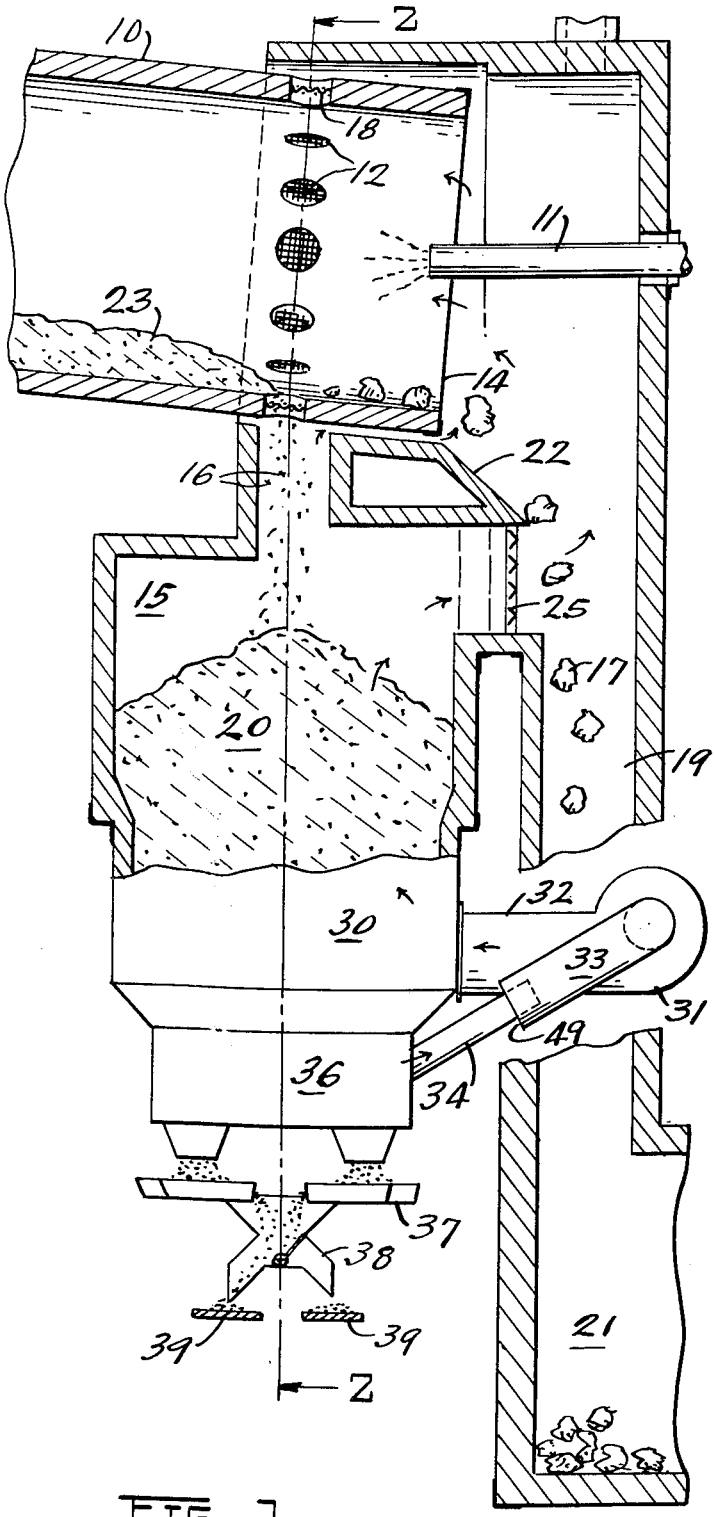
FIG. 1 is a side elevational view in cross section of the end portion of a kiln with discharge openings shown arranged in association with an underlying shaft type cooler according to the principles of the present invention.

Referring to the drawings in greater details, FIG. 1 shows a general arrangement of components of a cooler at the end of an inclined rotary kiln 10 in which limestone or other matter has been calcined or otherwise heat treated. Burner 11 is representative of one or more burners located on the discharge end of the kiln for supply of heat required for calcination or other heat treatment of the charge. The kiln 10 is inclined slightly downward relative to the horizontal to promote discharge of its processed output by gravity into the cooler chamber 15.

A series of discharge ports 12 extending through the wall of the kiln are spaced about the circumference of the kiln near its end to permit passage of particles 16 of predetermined acceptable size for discharge from the kiln to a particle bed 20. Larger size agglomerate groups or debris 17 are caused to pass on and flow out the extreme end 14 of the kiln. By way of example, in a ten foot diameter kiln there can be typically about ten ports provided about the kiln circumference. The ports can be of the same size in the range of less than 10 inches to more than 20 inches in diameter. Each can be fitted with a high temperature resistant metal grille or grid 18 made of high temperature material such as chrome-nickel alloy to divide the opening into smaller openings to permit passage of particles which are under a preselected acceptable size such as up to a five to six inch dimension. Larger pieces of kiln coating 17, or for example, masses of lime, or clinkers or foreign matter over 6 inches in dimension, are thus caused to flow over the ports 12 on to the end 14 of the kiln and into a discharge chute 19 from which they drop into a reprocessing or disposal region 21.

Figure 2:
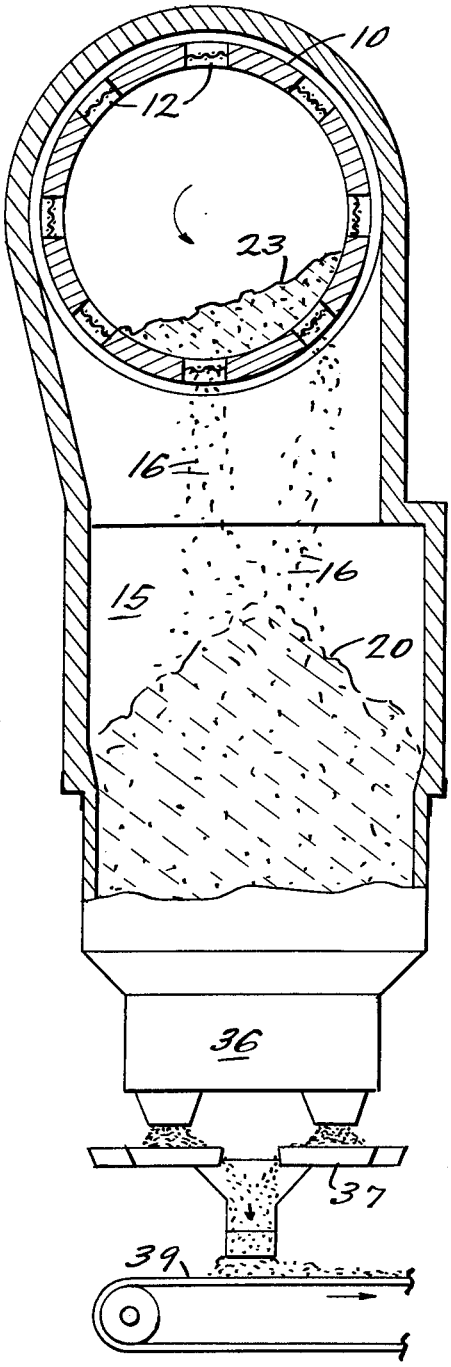
FIG. 2 is a cross-sectional view of the kiln and cooler combination of FIG. 1 as taken on Line 2—2 thereof.

As illustrated in FIG. 2, the cooler tends to be offset from the center of the kiln in the direction of rotation of the kiln. The charge 23 in the kiln is moved upward in the direction of rotation of the kiln and accordingly particles discharged from the ports into the bed 20 would normally tend to be deposited to one side of a centered cooling chamber 15. Accordingly the cooler is designed with the bed chamber 15 slightly offset from the kiln center to cause the discharging particles to be deposited more centrally in the chamber 15 for a more even distribution of hot particles flowing from the kiln 10 into the cooling bed 20.

The material in the bed 20 of the shaft type cooler shown moves generally downwardly and continuously into a cluster of louvered hoppers for example four hoppers located in side-by-side relation about the center of the bed in an arrangement like that shown in my U.S. Pat. No. 3,721,017. Cooling air flowing upwardly through the bed 20 and into the upper part of the chamber 15 is allowed to exit from the cooling chamber through an open partitioning grid 25 located below the deflector 22 and flow upwardly in the region above the discharge chute for passage into the end 14 of the kiln as preheated air for combustion heating the charge 23 within the kiln.

The cooling air is supplied to the bed 20 by way of a plenum 30 connected by a duct 32 to a fan 31. Air is drawn by the fan 31 from a main metering inlet duct 33 open to the atmosphere at an entrance orifice 49. Air is also supplied to the inlet duct 33 by way of a conduit 34 connected to the exit plenum 36 which acts to air lock the cooler and prevent blowout to atmosphere at the feeders.

Cooled material of the bed is discharged from the hoppers onto electro-vibrating feeders 37 or other suitable feeders and by way of a gate arrangement 38 ultimately to either of two conveyor belts 39.

As a usually less preferred alternate to the arrangement thus described, the partition grid 25 shown in FIG. 1 may be blocked off, or in other words walled up, to cause the air to flow up into the kiln through the ports 12 and through the region between the kiln end 14 and the deflector 22 around the end of the kiln.

Figure 3:
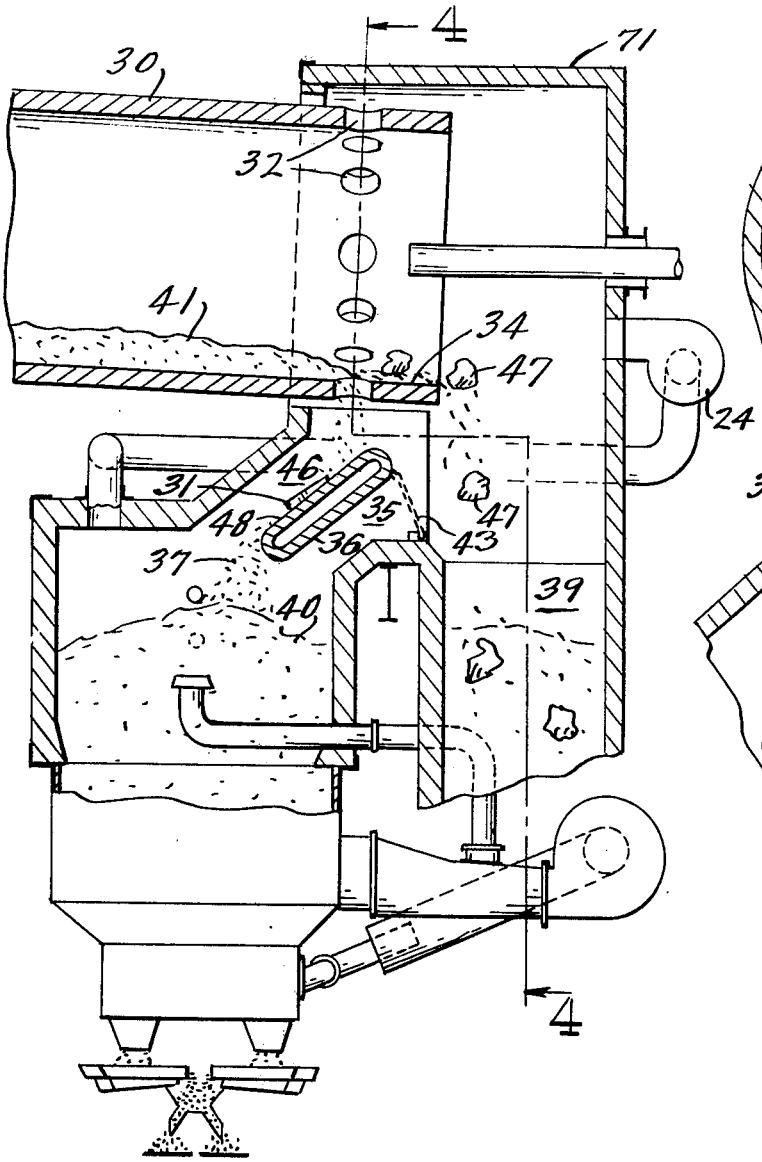
FIG. 3 is a partial side elevation view in cross section of another cooler arrangement of my invention wherein a distributor and supplemental deflector members are utilized to convey particulate matter from kiln discharge openings to a cooler bed.
Figure 4:
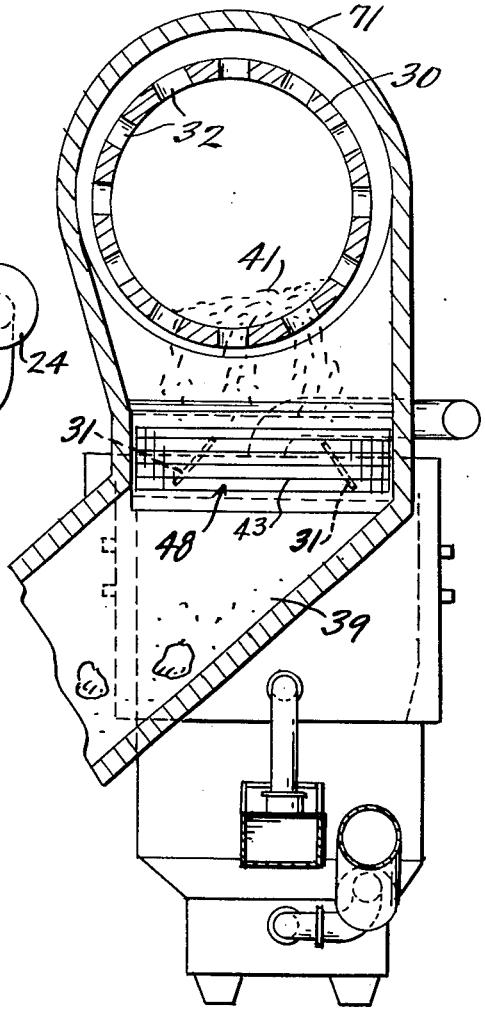
FIG. 4 is cross sectional view of the end of the kiln and cooler combination as taken on Line 4—4 of FIG. 3.

FIGS. 3 and 4 illustrate another arrangement of my invention wherein the output from the kiln 30 is discharged through ports 32 which allow passage of particles 37 of less than a preselected size therethrough. The particles 37, are directed through a channel 46 formed by a distributor 36 having associated supplemental deflector members 31. Larger particles and debris 47 are passed on and out of the end of the kiln 30 into the discharge region 39. Particles of acceptable size are discharged from the ports 32 onto the surface of the deflector 48. The deflection surface is sufficiently wide to effect distribution of the particles over a wide dimension of the cooler bed 40. By suitable location and orientation of the channel 46 and by the addition of supplemental deflectors 31, particles can be uniformly distributed across the bed 40 to promote establishment of an even resistance to flow of air upwardly through the bed and out therefrom as preheated air. A hot air flow channel 35 is provided under the distributor 36 to direct the air upwardly for introduction to the end of the kiln as part of the combustion air for heating of the charge 41 in the kiln. A grille 43 is oriented to preclude entrance of large particles into the channel 35.

This flow of air to the kiln via a route other than upwardly through the discharge ports 32 can be promoted where desired or necessary by use of a fan 24 which can be made to control all or part of the air exiting from the cooler bed 41. By connecting this fan to the channel 46 leading to the cooling chamber 15 just under the ports 12, or connecting the fan directly to the cooling chamber, a relatively small air movement will insure that no significant crossflow of cooler air and kiln product will exist. Thus difficulty with possible dust entrainment and blowback into the kiln is elminated. This air withdrawn from the particle flow channel 46 is introduced to the firing hood above the oversized particle discharge chute 39 for introduction to the kiln along with the air flowing up from the bed 40 and into the kiln.

Figure 5:
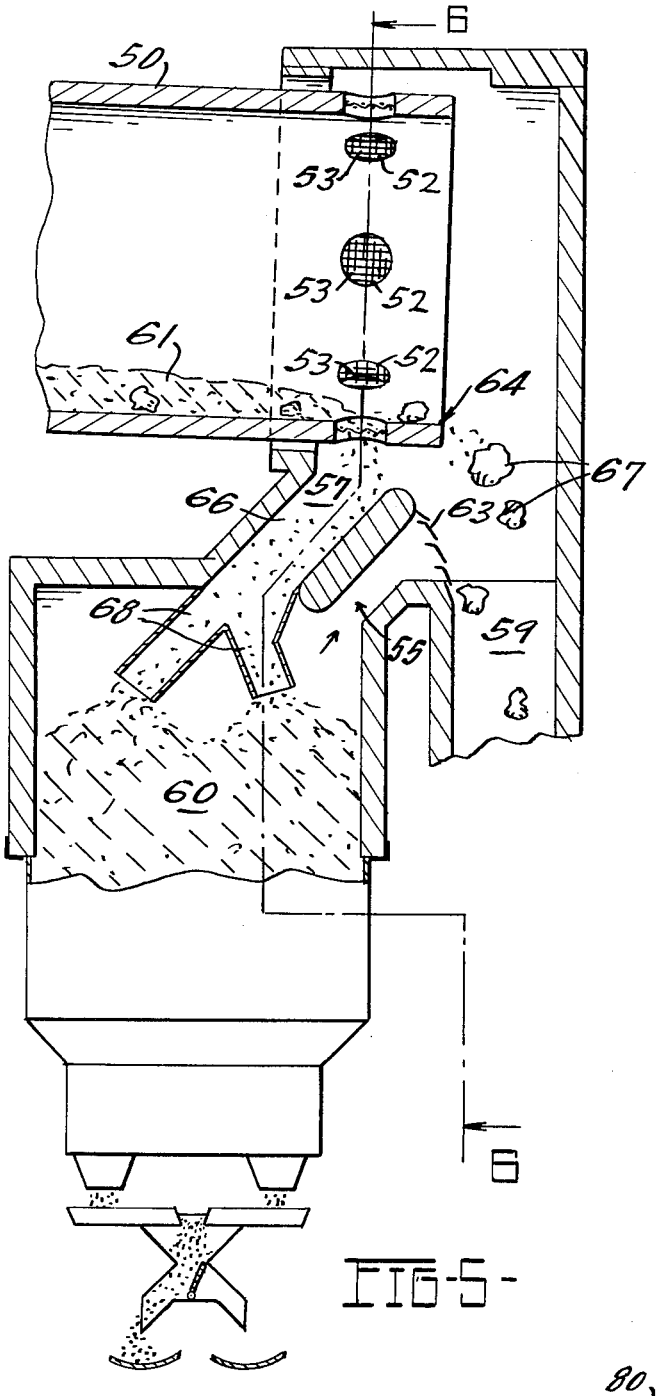
FIG. 5 is a partial side elevational view in cross section of still another cooler arrangement wherein discharge openings of a kiln and distributor chutes are interassociated to effect uniform distribution of particulate matter of the kiln in a cooler bed below.
Figure 6:
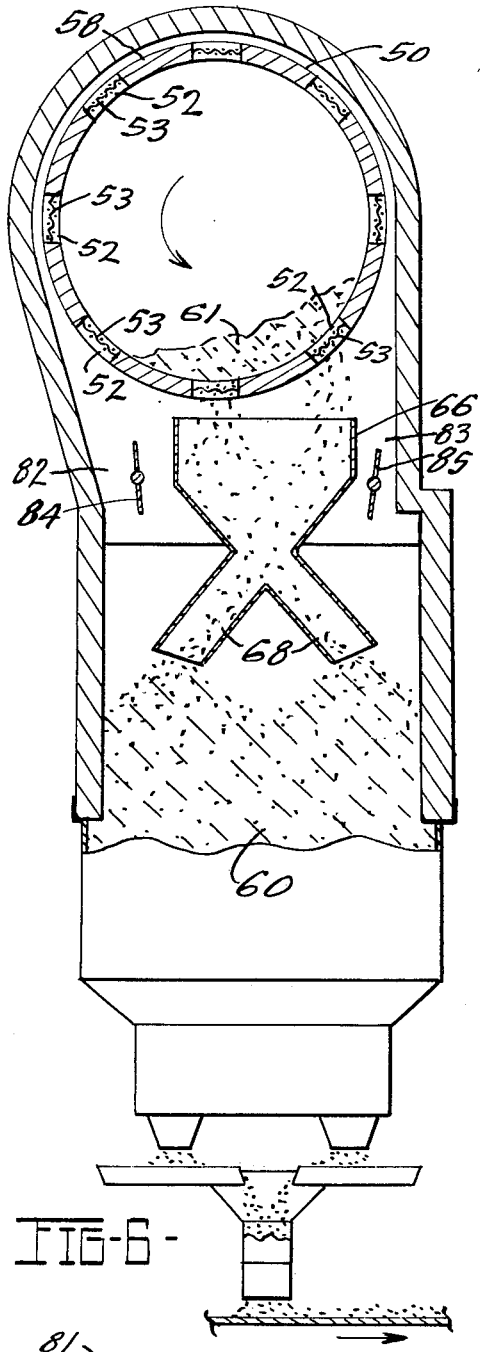
FIG. 6 is a cross-sectional view of the kiln and cooler combination of FIG. 5 as taken on Line 6—6 of FIG. 5.

FIGS. 5 and 6 illustrate still another form of my invention wherein the output from the kiln 50 is discharged through ports 52 each of which is provided with a grille 53 to subdivide the opening of the port for selective discharge of smaller particles 57 than the size of the port itself. The smaller selected particles 57 of the charge 61 are passed through the port grilles and deposited in an angular hopper 66 from which they are conveyed into the bed 60 by way of chutes 68 each of which has an exit over a desired deposition region of the bed 60. By such a chute arrangement, the discharge from the kiln through the ports 52 can be distributed to any of a number of sub-regions at the top of the bed 60.

The particles larger than desired of the kiln charge 61 pass over the grilles 53 of the ports 52 and are conveyed to the end 64 of the kiln and discharged as oversized particles 67 into the region 59 for further processing or disposal as desired. The cooling air after passage up through the bed 60 is channeled as heated air to the kiln end 64 through a grid 63 in an air channel 55 under the angularly disposed hopper region 66. This heated air is introduced to the kiln as part of the combustion air for heating the charge 61 in the kiln. The grid 63 over the exit of the air channel 55 serves to assure that the oversized particles 67 do not fall back into the bed 60 through the air channels 55.

As illustrated more clearly in FIG. 6, the charge 61 flows upwardly to the side of the kiln 50 in its direction of rotation. Thus particles discharged from the ports 52 are discharged off from the center or bottom-most region of the kiln and upwardly in the direction of rotation to one side of the kiln. The hopper region 66 which feeds the chutes 68 thus is purposely located in an offset position in the direction of discharge of material from the kiln and is made sufficiently wide to assure receipt of the discharge from the ports 52 and for uniform distribution to the number of chutes 68 extending therefrom. Thus the discharged particles 57 can be directed to and deposited in a number of regions in the bed 60. The chutes 68 can be made adjustable so that the discharge therefrom can be located for even distribution of the particles 57 into the bed and thereby assure a uniform resistance to cooling air flow up through the bed 60. This arrangement also prevents cross flow of cooler air and kiln product, thus eliminating the problem frequently encountered in other coolers of dust entrainment and blowback into the kiln. Passages 82 and 83 can be blocked such as with dampers 84 and 85 respectively or left open to preclude or permit passage of air from the cooler.

Figure 7:
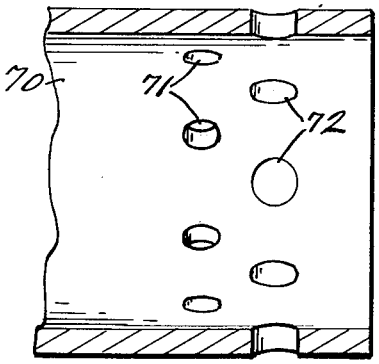
FIG. 7 is an illustration of a discharge end of a kiln with discharge openings in more than one row.
Figure 8:
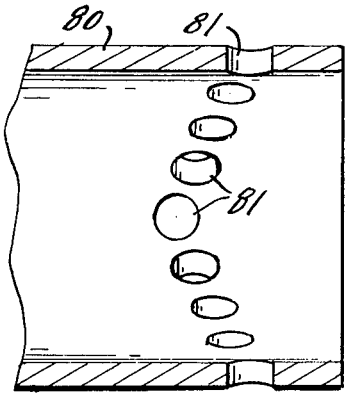
FIG. 8 is an illustration of a discharge end of a kiln with discharge openings aligned for a broad distribution of particulate material discharged from the kiln.

As variations of my present invention and as contemplated within the scope of the disclosure and claims herein set forth, the discharge ports of the kiln can be of different shapes such as oval or provided with the inclined side walls to be funnel-like to direct the preselected sized particles to desired locations in the cooling bed. In this regard, the ports might also be arranged side by side in two or more rows or might be staggered as in FIG. 7 in two or more rows such as ports 71 and 72 near the end of kiln 70 to provide a band of discharge near the end of the kiln. The ports might be of two or more different sizes or shapes represented by ports 71 and 72. Thus the particles can be divided out first according to one size then according to another before still larger particles are discharged over the end of the kiln. The selected sizes can then be conveyed to different portions of the bed such as by chute arrangements. The ports might also be angularly arranged as shown in FIG. 8 in a somewhat helical-oriented row of ports 81 near the end of kiln 80 to broaden the discharge band. Subdividing grids for selection of particles smaller than the port sizes can also be used in such ports as desired. The ports also might be lined with special high temperature wear resistant materials such as a metal alloy such as a chrome nickel alloy or special ceramic material to promote greater wear resistance against particles passed therethrough.

In view of the foregoing, while the invention has been described in considerable detail with regard to the illustrated embodiments, it will be recognized and understood that my invention is not limited specifically to the particular arrangement, shown and described, and accordingly by the appended claims, all adaptions, modifications, and arrangements thereof are contemplated which fall within the spirit and scope of the invention.

I claim:

1. Apparatus for pyroprocessing of particulate matter comprising a rotary kiln and a shaft type particle cooler associated therewith, said kiln having a discharge end for discharge of particles larger than a preselected size and a circumferentially spaced series of openings for discharge of particles of size smaller than said preselected size through the kiln shell located near said discharge end, said shaft type cooler having a cooling bed disposed below said kiln for direct receipt of particles passed through said openings.

2. Pyroprocessing apparatus according to claim 1 wherein the discharge openings have grilles associated therewith subdividing said openings into apertures of size to allow discharge therethrough of kiln processed particles of size less than a predetermined size while larger particles are passed beyond said grilled openings.

3. Pyroprocessing apparatus according to claim 1 wherein the discharge openings are lined with a high temperature wear resistant material.

4. Pyroprocessing apparatus according to claim 1 wherein the withdrawn air and dust are introduced into the exit end of said kiln for combustion processing of particles therein.

5. Apparatus for pyroprocessing of particulate matter comprising a rotary kiln having a discharge end for discharge of particles larger than a preselected size and a circumferentially spaced series of openings for discharge of particles of size smaller than said preselected size through the kiln shell located near said discharge end, some of said material discharge openings being linearly offset from others in a direction parallel to the axis of rotation of said kiln to effect a desired pattern of discharge of material from said kiln to a region below.

6. Apparatus for pyroprocessing of particulate material comprising, a circumferentially rotatable cylindrical kiln having a material input end and a material output region at its opposite end, circumferentially spaced material discharge openings in said kiln wall located near the edge of said material output end for discharge therethrough of kiln processed particles, some of said discharge openings being larger than others.

7. Pyroprocessing apparatus according to claim 6 wherein the larger openings are linearly offset from the smaller openings in a direction parallel to the rotational axis of said kiln.

8. Apparatus for pyroprocessing of particulate material comprising a generally horizontal cylindrical rotary kiln having a material inlet end and a material exit end, said kiln being inclined slightly downward toward its exit end, a plurality of material openings provided in the kiln wall circumferentially distributed near the exit end for release of material passed through said kiln before reaching the end of the kiln, said openings being of size to allow passage therethrough of particulate matter of size smaller than a predetermined size while causing larger particles to pass on for discharge from the exit end of said kiln, said kiln openings being disposed to release particles directly from said kiln into the bed of a particle cooling unit while the exit end of the kiln for large particles is disposed to release said larger particles into a different region for receipt of particles of unacceptable size.

9. Pyroprocessing apparatus according to claim 8 wherein a deflector member is disposed to deflect the flow of large particles from said exit end of the kiln to the region for particles of unacceptable size.

10. Pyroprocessing apparatus according to claim 8 wherein guide means below said kiln openings are disposed for receipt of particles discharged from said openings and oriented for distribution of received particles substantially uniformly to the region of the bed of said cooler.

11. Pyroprocessing apparatus according to claim 8 wherein the cooling unit is a shaft type cooler from which air flows upwardly from a cooling bed region under said guide surface and into the exit end of said kiln for combustion processing of particles in said kiln.

12. Pyroprocessing apparatus according to claim 8 wherein air flow means is provided to withdraw air and dust particles from the region above said cooling bed adjacent said kiln openings to minimize tendencies for flow of air to said kiln through said openings.

13. The method of cooling particulate material pyroprocessed through a kiln comprising passing particles larger than a predetermined size out the end of the kiln, discharging particles of said predetermined size and less through circumferentially spaced openings of said predetermined size in the wall of the kiln, accumulating said discharged pyroprocessed particles directly in the cooling bed of a shaft cooler and withdrawing particles from said bed which are cooled therein, passing cooling air directly up through said bed to cool said particles whereby said air is heated by the heat of said particles and then introducing the heated air into the discharge end of the kiln for combustion processing of the particles therein.

* * * * *